US007984527B2

(12) United States Patent
Georgieff

(10) Patent No.: US 7,984,527 B2
(45) Date of Patent: Jul. 26, 2011

(54) HANDHELD CLEANING IMPLEMENT

(76) Inventor: George Georgieff, Toronto (CA)

( * ) Notice: Subject to any disclaimer, the term of this patent is extended or adjusted under 35 U.S.C. 154(b) by 260 days.

(21) Appl. No.: 12/381,463

(22) Filed: Mar. 12, 2009

(65) Prior Publication Data

US 2010/0088839 A1 Apr. 15, 2010

Related U.S. Application Data

(60) Provisional application No. 61/195,912, filed on Oct. 14, 2008, provisional application No. 61/197,389, filed on Oct. 28, 2008.

(51) Int. Cl.
*A47L 13/146* (2006.01)

(52) U.S. Cl. ..... 15/119.2; 15/105; D32/44

(58) Field of Classification Search ..... 15/116.2, 15/119.2, 105; D32/44
See application file for complete search history.

(56) References Cited

U.S. PATENT DOCUMENTS

| | | | | | |
|---|---|---|---|---|---|
| 2,683,887 | A * | 7/1954 | Bell | ..... | 15/119.2 |
| 2,694,210 | A * | 11/1954 | Bitzer et al. | ..... | 15/119.2 |
| 3,287,756 | A * | 11/1966 | Gesell | ..... | 15/119.2 |
| 4,893,369 | A * | 1/1990 | Johnson | ..... | 15/119.2 |
| 5,575,032 | A * | 11/1996 | Cernuska | ..... | 15/119.2 |

* cited by examiner

*Primary Examiner* — Mark Spisich
(74) *Attorney, Agent, or Firm* — Stuart M. Goldstein

(57) ABSTRACT

A cleaning implement is specifically designed to be held with one hand during cleaning operations. The implement has an upper control section and a lower cleaning section which are detachable from each other. The lower section is primarily a cleaning element in the form of a sponge member or similar compressible pad or component. A cleaning control arm and a moisture squeeze arm extend from the upper control section. When the implement is to be used in its cleaning mode, the control arm is held in one hand by the user to clean soiled surfaces. Moisture accumulating in the cleaning element is squeezed out simply by rotating the squeeze arm away from the control arm, such that the cleaning element is squeezed or compressed between base plates supporting each of the arms. For continued use in the cleaning mode, the squeeze arm is simply released and allowed to return to its position adjacent to the control arm.

6 Claims, 5 Drawing Sheets

HANDHELD CLEANING IMPLEMENT

This application claims the benefit of provisional application Ser. No. 61/195,912, filed on Oct. 14, 2008, and provisional application Ser. No. 61/197,389, filed on Oct. 28, 2008.

BACKGROUND OF THE INVENTION

Manually operable, handheld cleaning implements often use sponge or other compressible material applicators or elements to clean dishes, pots, appliances, countertops and other soiled surfaces. While many such implements have been developed, they are rarely found in the commercial marketplace. This is the case since the configurations and structural features of such prior implements make most of them inefficient, cumbersome to use, and expensive to manufacture.

As a result, a small implement, ergonomically designed to be held with one hand, comprising a self-wringing sponge holder and scraper combination which is easy to use, efficient in operation, and economical to manufacture would represent a substantial improvement in the art. Such an implement could be used for wiping, cleaning, absorbing liquids, scraping, and scrubbing surfaces, while ensuring that the hands of the user are kept away from the water, dirt, chemicals, detergents, germs, etc. on the soiled surfaces to be cleaned. The implement should also be designed to easily and cleanly squeeze moisture from its cleaning element. When a scraper is also provided, engrained soiled surfaces can be removed.

SUMMARY OF THE INVENTION

It is thus an object of the present invention to overcome the disadvantages and limitations of prior manually operated handheld implements and provide an implement which addresses these disadvantages and limitations.

It is an object of the present invention to provide a handheld cleaning implement which is designed to be used, in its cleaning mode, with one hand, to clean, wipe, scrape, and scrub soiled surfaces.

It is another object of the present invention to provide a handheld cleaning implement which is lightweight and easily manipulated for cleaning with one hand.

It is still another object of the present invention to provide a handheld cleaning implement which has a cleaning element, in the form of a sponge component, which can easily and quickly be squeezed of moisture, during the cleaning operation continues.

It is a further object of the present invention to provide a handheld cleaning implement which keeps the hands of the user away from the water, dirt, chemicals, detergents, and germs associated with the cleaning operation.

It is still another object of the present invention to provide a handheld cleaning implement which has a scraper component to clean engrained soiled surfaces.

It is another object of the present invention to provide a handheld cleaning implement which simply and quickly allows for the replacement of worn cleaning elements with new cleaning elements.

It is still another object of the present invention to provide a handheld cleaning implement which is easily and economically manufactured.

These and other objects are accomplished by the present invention, a cleaning implement specifically designed to be held with one hand during cleaning operations. The implement has an upper control section and a lower cleaning section which are detachable from each other. The lower section is primarily a cleaning element in the form of a sponge member or similar compressible pad or component. A cleaning control arm and a moisture squeeze arm extend from the upper control section. When the implement is to be used in its cleaning mode, the control arm is held in one hand by the user to clean soiled surfaces. Moisture accumulating in the cleaning element is squeezed out simply by rotating the squeeze arm away from the control arm, such that the cleaning element is squeezed or compressed between base plates supporting each of the arms. For continued use in the cleaning mode, the squeeze arm is simply released and allowed to return to its position adjacent to the control arm.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 2:
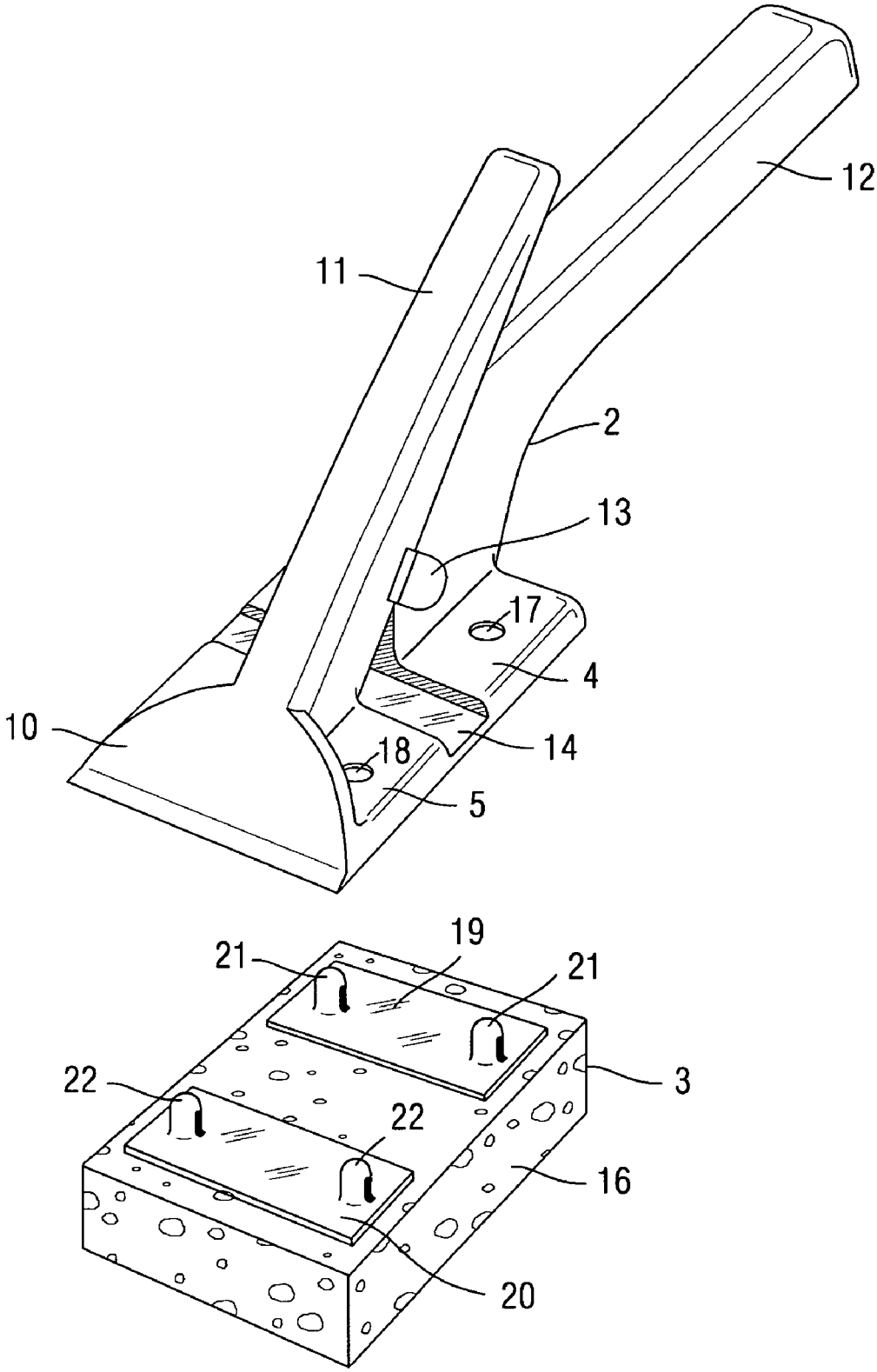
FIG. 2 is an exploded isometric view of the two sections of the cleaning implement of the present invention.
Figure 3:
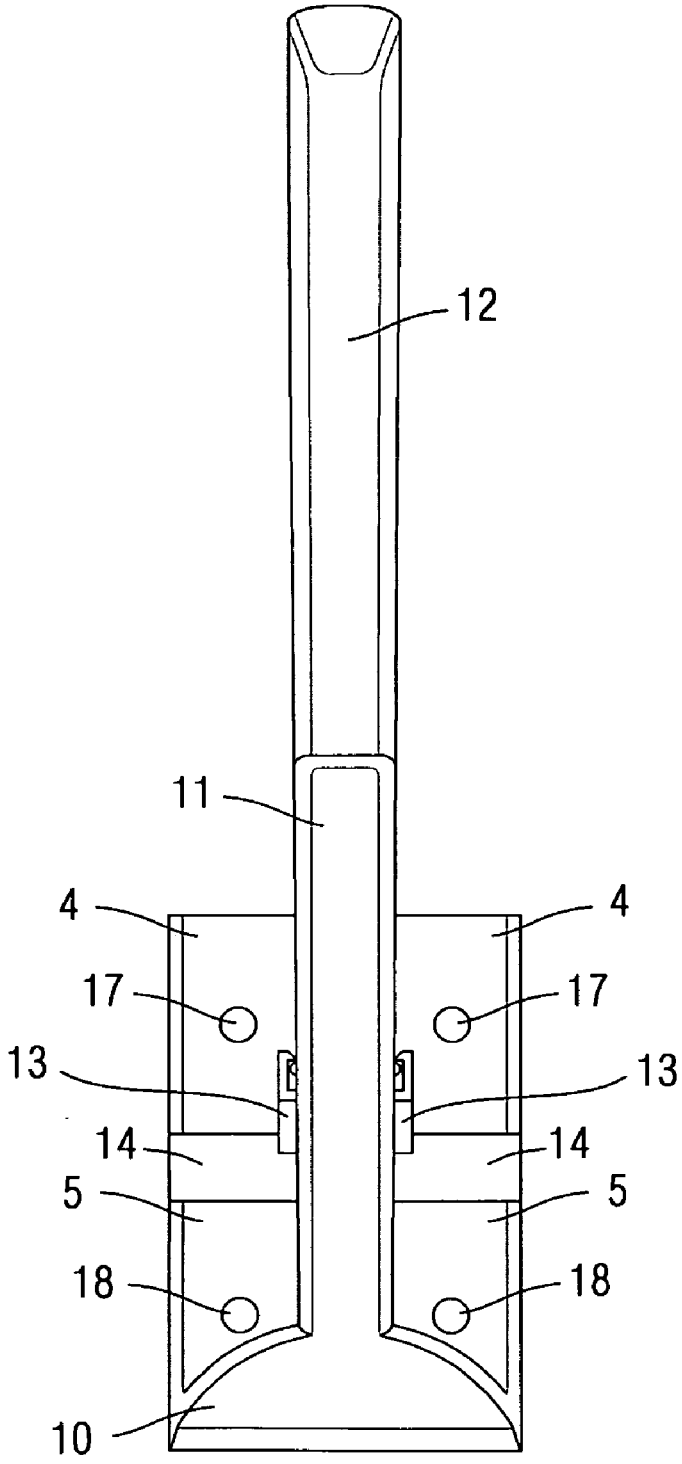
FIG. 3 is a top view of the upper section of the cleaning implement of the present invention.

Cleaning implement 1 is specifically designed to be held with one hand for wiping, cleaning, scrubbing, scraping etc., soiled surfaces. Cleaning implement 1 is made up of upper control section 2 and lower cleaning section 3, best seen in FIG. 2. Upper control section 2 comprises first base member 4 and second base member 5 interconnected by living hinge 14. It is contemplated that hinge 14 will be fabricated as a thin bendable strip, made of flexible plastic or equivalent material, capable of withstanding innumerable bending/pivoting actions. Base member 4 has through openings 17 and base member 5 has through openings 18, for purposes described hereinafter.

Figure 1:
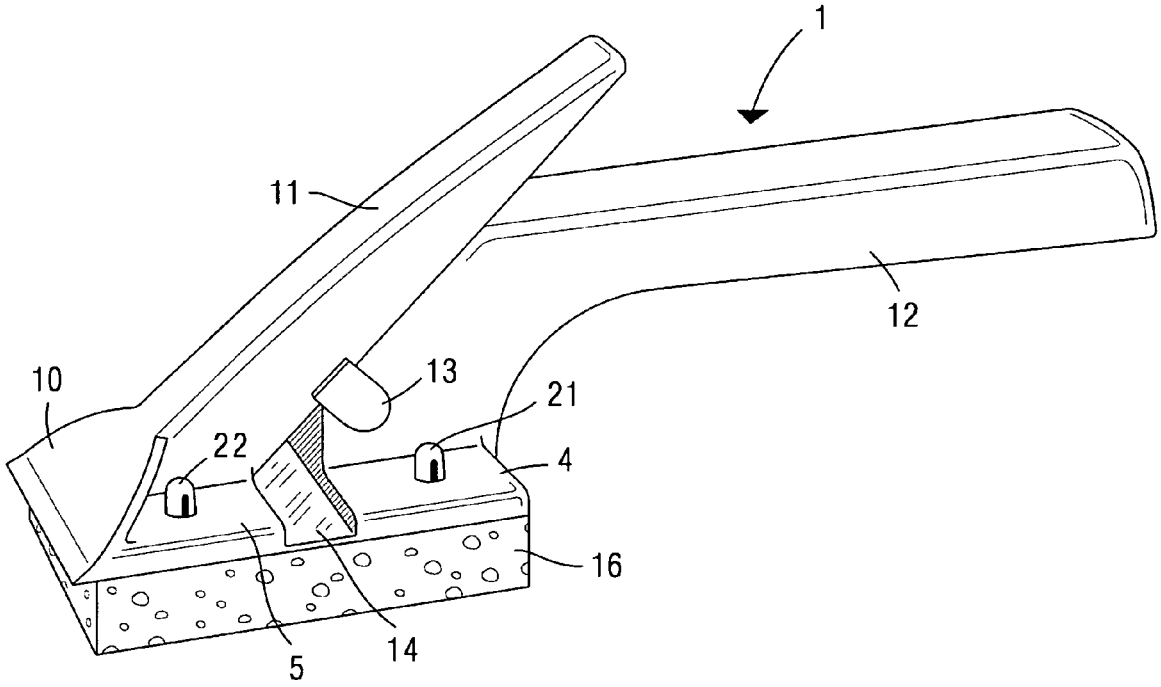
FIG. 1 is an isometric view of the cleaning implement of the present invention.

Cleaning control arm 12 extends outward and laterally from base member 4 of upper control section 2. Moisture squeeze arm 11 extends from base member 5 at an angle to control arm 12. When implement 1 is in its cleaning position or mode, as best seen in FIG. 1, base members 4 and 5 are located in the same transverse plane and squeeze arm 11 is adjacently aligned with control arm 12. Detent tab 13 on squeeze arm 11 is configured to engage detents 9 located on both sides of control arm 12 to lock the arms together in the cleaning mode. Scrapper section 10 is located at the forwardmost end of squeeze arm 11 and the scrapper protrudes forward of base member 5.

Lower cleaning section 3 comprises squeezable cleaning element 16, which optimally is a sponge component, but could comprise any moisture absorbent, squeezable material or compressible pad. Connector plates 19 and 20, with protruding clips 21 and 22 respectively, are permanently attached to cleaning element 16. Clips 21 and 22 are insertable into openings 17 and 18 in base members 4 and 5 to permit detachable connection of lower section 3 to upper section 2.

By this connection means, when cleaning element 16 becomes worn out and ineffective after prolonged use, old lower section 3 can be unclipped from upper section 2 and replaced with a new lower section having a fresh cleaning element 16.

Figure 4:
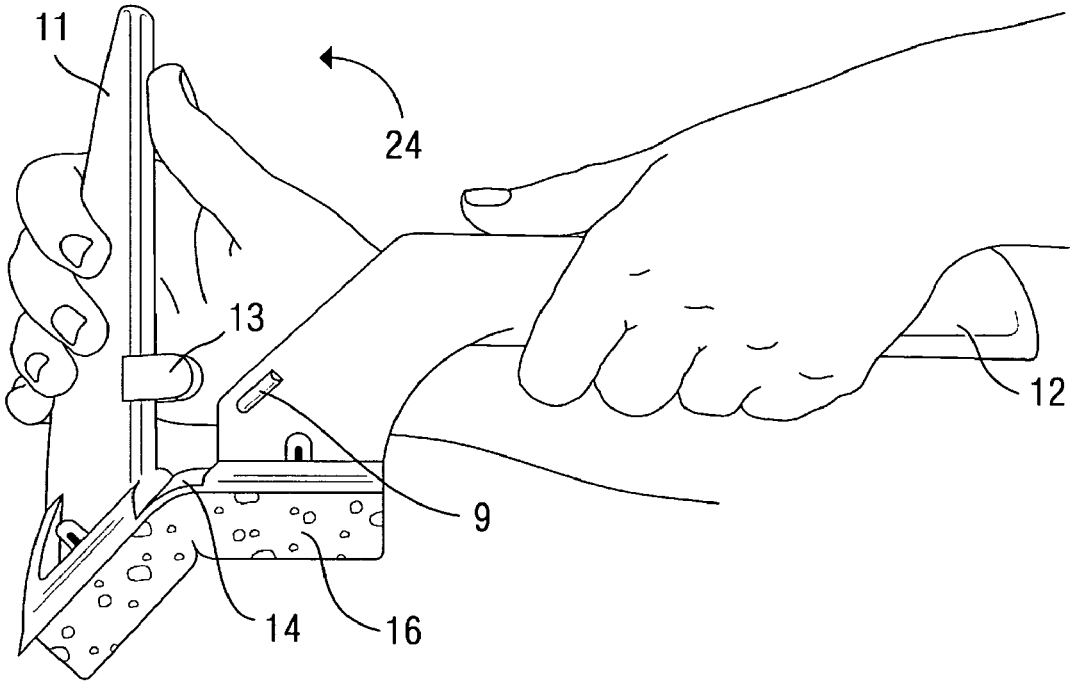
FIG. 4 is a side view of the cleaning implement of the present invention, transitioning from its cleaning mode to its moisture squeezing mode.
Figure 5:
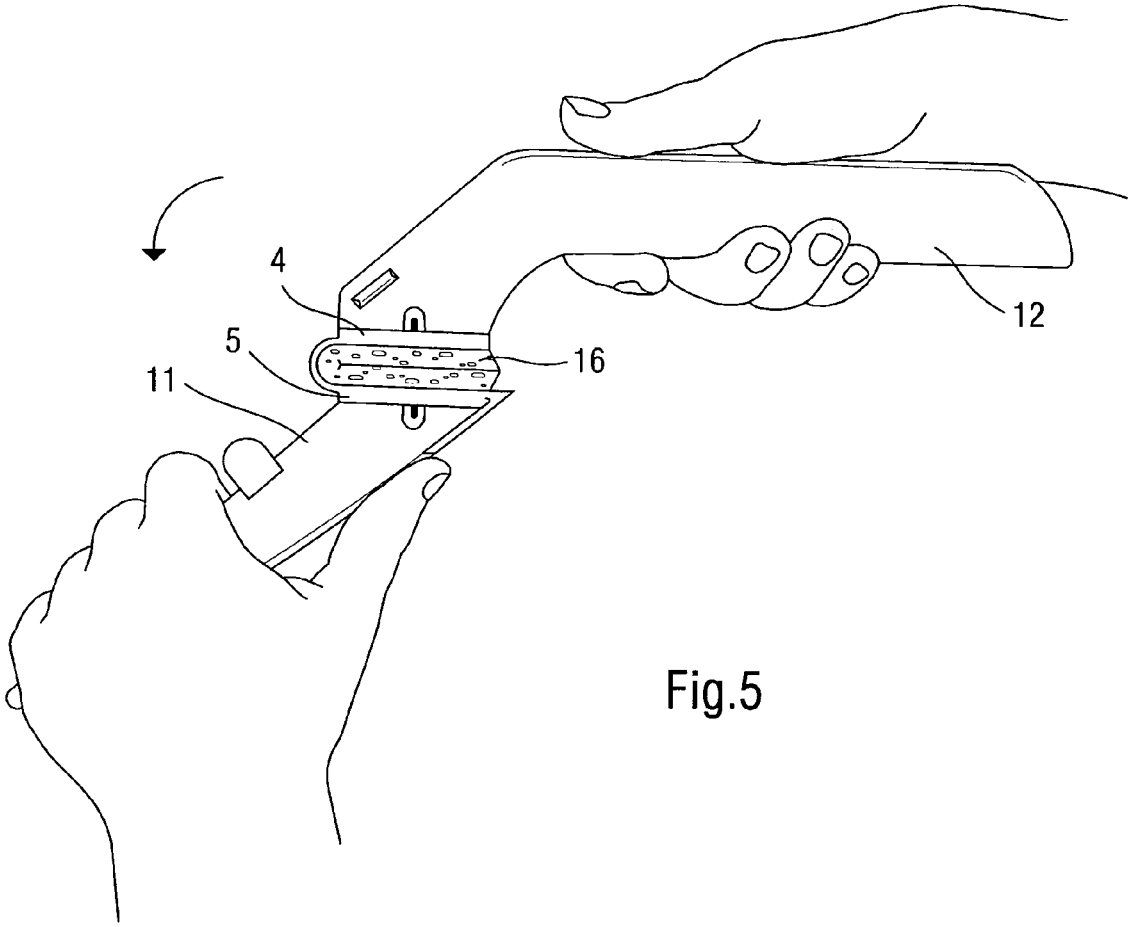
FIG. 5 is a side view of the cleaning implement of the present invention in its moisture squeezing mode.

Handheld implement 1 will normally be employed in the cleaning mode seen in FIG. 1, with cleaning element 16 used on normally soiled surfaces and scraper 10 addressing more engrained dirt. However, when excessive moisture has accumulated in cleaning element 16, the user, while continuing to grasp control arm 12 with one hand, takes hold of squeeze arm 11 with the other hand. Squeeze arm 11 is then pulled off detents 9, and the squeeze arm is rotated 24 away from control arm 12. See FIG. 4. Hinge 14 bends to allow this rotation. Rotation of squeeze arm 11 around hinge 14 continues until base members 4 and 5 are approximately parallel to each other. In this position, as seen in FIG. 5, moisture is efficiently squeezed out of cleaning element 16, which is compressed between the base members. The user then releases squeeze arm 11 so that it can return to its cleaning mode (FIG. 1) where squeeze arm detent tab 13 is again engaged with detents 9 on control arm 12.

For optimum ergonomic effectiveness in using implement 1 in both the cleaning and squeezing modes, the length of lower cleaning section 3 should be approximately one half the length of control arm 12. Ratios of control arm length to lower cleaning section length ranging between 3 to 1 and 1.5 to 1 will also allow effective use of implement 1.

While cleaning element 16 and base members 4 and 5 are shown as being rectangular, it is within the scope of the invention that these components be of any convenient shape, e.g. circular, square, triangular, etc.

Upper control section can easily and economically be fabricated out of plastic material, using known injection molding techniques. Connection plates 19 and 20 are similarly made and attached, by known processes, to cleaning element 16.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A handheld cleaning implement configured to be rotatable between a cleaning mode and a moisture squeezing mode, said implement comprising:

an upper control section comprising a first base member having an upstanding cleaning control arm comprising a lower support component extending up from the first base member and a handle component extending laterally outboard of the implement, said handle component at no time being positioned over the first base member, either when the implement is in the cleaning mode or in the moisture squeezing mode, and a second base member having an upstanding squeeze arm which, when the implement is in the cleaning mode, extends from the second base member at an angle to and is adjacently aligned with the lower support component of the control arm, the squeeze arm comprising a front scraper protruding forward of the second base member, said upper section further comprising hinge means between the first and second base members for interconnecting the base members and for permitting the second base member to rotatably pivot in relation to the first base member;

a lower cleaning section having a length which is at least one third the length of the control arm, said cleaning section comprising a squeezable cleaning element; and means for connecting the lower cleaning section directly to the base members of the upper section to secure the lower section to the upper section;

whereby in the cleaning mode the base members are located in the same transverse plan, and in the moisture squeezing mode the control arm, squeeze arm and base members are rotatable to a position wherein the handle component and the squeeze arm extend in substantially opposite directions and the base members are substantially parallel to each other with the cleaning element squeezed therebetween.

2. The handheld cleaning implement as in claim 1 further comprising detent means for securing the squeeze arm to the control arm when the tool is in the cleaning mode.

3. The handheld cleaning implement as in claim 1 wherein the hinge means is a flexible, living hinge between the base members.

4. The handheld cleaning implement as in claim 1 wherein the means for connecting the lower section to the base members comprises tabs upstanding from the lower cleaning section and insertable into openings in the base members.

5. The handheld cleaning implement as in claim 1 wherein the lower cleaning section is approximately one half the length of the control arm.

6. The handheld cleaning implement as in claim 1 wherein the length of the control arm to the length of the lower cleaning section ranges between 3 to 1 and 1.5 to 1.

* * * * *